US005988806A

United States Patent [19]

Hall et al.

[11] Patent Number: 5,988,806

[45] **Date of Patent: *Nov. 23, 1999**

[54] METHOD FOR SEPARATING AND PURGING GASES FROM A FREE-INK INK-JET PEN

[75] Inventors: Ronald W. Hall; David R. Otis, Jr., both of Corvallis, Oreg.

[73] Assignee: Hewlett-Packard Company, Palo Alto, Calif.

[ * ] Notice: This patent is subject to a terminal disclaimer.

[21] Appl. No.: 09/040,739

[22] Filed: Mar. 18, 1998

Related U.S. Application Data

[62] Division of application No. 08/519,384, Aug. 25, 1995, Pat. No. 5,841,454.

[51] Int. Cl.[6] ..... B41J 2/19

[52] U.S. Cl. ..... 347/92

[58] Field of Search ..... 347/92, 85–87, 347/30

[56] References Cited

U.S. PATENT DOCUMENTS

| | | | |
|---|---|---|---|
| 4,301,459 | 11/1981 | Isayama et al. | 347/92 |
| 4,628,333 | 12/1986 | Terasawa | 347/87 |
| 5,841,454 | 11/1998 | Hall et al. | 347/92 |

*Primary Examiner*—N. Le
*Assistant Examiner*—Judy Nguyen

[57] ABSTRACT

An apparatus and method for removing air or other gases from a free-ink ink-jet pen is provided in a manner that does not waste ink or require disposal of purged ink. A gas separation and purge mechanism is incorporated into a pen body construct having an ink containment chamber such that gases will rise toward the mechanism. A vacuum is cyclically applied to the gas separation and purge mechanism to remove the gas and to allow the ink containment chamber to refill from a remote reservoir as needed.

6 Claims, 6 Drawing Sheets

METHOD FOR SEPARATING AND PURGING GASES FROM A FREE-INK INK-JET PEN

CROSS REFERENCE TO RELATED APPLICATION (S)

This is a divisional of application Ser. No. 08/519,384 filed on Aug. 25, 1995, now U.S. Pat. No. 5,841,454.

FIELD OF THE INVENTION

The present invention generally relates to ink-jet technology, more particularly to pens used in ink-jet technology and, more specifically to a gas separation and purge system for a free-ink ink-jet pen.

BACKGROUND OF THE INVENTION

The art of ink-jet technology is relatively well developed. Commnercial products such as computer printers, graphics plotters, and facsimile machines employ ink-jet technology for producing hard copy. The basics of this technology are disclosed, for example, in various articles in the *Hewlett-Packard Journal*, Vol. 36, No. 5 (May 1985), Vol 39, No. 4 (August 1988), Vol 39, No. 5 (October 1988), Vol. 43, No. 4 (August 1992), Vol. 43, No. 6 (December 1992) and Vol. 45, No. 1 (February 1994) editions, incorporated herein by reference. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988).

Generally, in the thermal ink-jet field, an ink-jet pen is provided with a printhead, having an orifice plate in combination with heating elements. Thermal excitation of ink is used to eject droplets through miniature nozzles and orifices, onto a print medium, forming alphanumeric characters or images using dot matrix manipulation. Other types of ink droplet generators, such as the use of piezoelectric transducers, are also known in the art.

The pen may also serve as a reservoir for storing ink and providing appropriate amounts of ink to the printhead during a printing cycle. Ink can be stored in a contained medium, such as a permeable foam material, in a disposable pen (see e.g., U.S. Pat. No. 4,771,295 (Baker et al.), assigned to the common assignee of the present invention and incorporated herein by reference). Or, the pen can be a free-ink type, where the ink is supplied to a printhead mechanism from an on-board reservoir or, if refillable, from a remote ink supply to a relatively permanent printhead mechanism (see e.g., U.S. Pat. No. 4,929,963 (Balazai), assigned to the common assignee of the present invention, incorporated herein by reference).

While such pens provide a reliable and efficient means of "jetting" droplets of ink from the nozzle plate onto the print medium, the printheads generally require a mechanism to prevent the free flow of ink through the orifices when the printhead is not activated. Without this control, ink may leak, or "drool", onto the printing surface or into the hard copy transport and printer mechanism. Such leaking ink may also build up and cake on the printhead itself, impairing proper operation. Complex pen service stations are often provided where pens can be wiped or activated to "spit" away excess ink.

To alleviate this problem, many ink-jet printers supply ink from the reservoir to the printhead at a slight under pressure, also referred to in the art as "back-pressure" or "negative pressure" operation, such as at about minus three (−3) inches Water Column (WC) lower than the ambient atmospheric pressure at the printhead. To be effective, this pen back-pressure must be maintained consistently and predictably within a desired operating range. That is, the pen back-pressure must be large enough to prevent the unwanted free flow of ink through the orifices, yet at the same time, small enough so that the printhead, when activated, can overcome the back-pressure and eject ink droplets in a consistent and predictable manner. This back-pressure will be affected by changes in either or both the ambient atmospheric pressure or the internal pressure. Likewise, temperature variations may cause the ink and air within the ink-jet pen to contract or expand, also affecting the back-pressure. Therefore, these factors must be accounted for and a mechanism should be incorporated into an ink-jet pen to maintain the back-pressure within the predetermined desirable operating range.

In a foam reservoir pen, the capillary action of the foam will generally be sufficient to create the desired back-pressure. In a free-ink reservoir type ink-jet pen, a variable volume, local reservoir is often employed. For example, the reservoir may be of a biased, flexible material which can expand or contract as shown in U.S. Pat. No. 4,500,895 assigned to the assignee of the present invention and incorporated herein by reference. Or, an on-board ink containment chamber may be provided which includes a pressure regulator device as shown in U.S. Pat. No. 4,509,602, assigned to the common assignee of the present invention and incorporated herein by reference. U.S. Pat. No. 4,677,447, assigned to the common assignee of the present invention and incorporated herein by reference, describes the use of a check valve in a printing device with an on-board ink reservoir that maintains a constant pressure difference between the ink reservoir and the ink-jet printhead. U.S. Pat. No. 5,650,811 (Seccombe et al.), assigned to the common assignee of the present invention and incorporated herein by reference, describes a pressure regulator located on-board an ink-jet pen using an off-board ink reservoir.

As the volume of ink within the reservoir varies due to depletion, thermal or ambient pressure variations, and the like, the volume of the local ink containment chamber also varies. The back-pressure range can be affected by the introduction of gases into the free-ink reservoir. For example, air can be sucked up through the orifice plate or out-gassed from the ink composition. As a biasing regulator mechanism is specifically designed to maintain the back-pressure in the printhead mechanism local ink containment chamber within a predetermined range, such unpredictable and thus unaccounted for gases may adversely affect operation. Therefore, these gases must be removed from a free-ink reservoir if the printhead and regulator mechanism does not have enough compliance to prevent the expanding gases from forcing ink out of the orifices during temperature and altitude excursions.

Thus, there is a need for an gas purge and separator mechanism for free-ink ink-jet pen devices.

SUMMARY OF THE INVENTION

In its basic aspects, the present invention provides a pen for an ink-jet hard copy apparatus that includes a mechanism for providing a suction. The pen includes a pen body including an ink containment chamber; a printhead mechanism coupled to said ink containment chamber; a mechanism, incorporated with said pen body, for filling said ink containment chamber and for regulating back-pressure at said printhead mechanism; and a mechanism, incorporated with said pen body, for separating and purging gas from said pen body on demand using said mechanism for providing a suction.

The present invention encompasses a method for separating and purging gases from a free-ink ink-jet pen by providing said pen with a chamber having a predetermined volume capacity where gases can be accumulated; and cyclically applying a vacuum force to said chamber to remove said predetermined volume.

It is an advantage of the present invention to provide a simple and reliable mechanism for purging gases from a free-ink ink-jet pen.

It is another advantage of the present invention that it provides a gas purge and separator mechanism that can be automated for cyclical operation.

It is a further advantage of the present invention that gases are removed from the top side of the pen and not through the nozzles where printing could be temporarily interrupted due to the presence of lodged bubbles.

It is another advantage of the present invention that it eliminates the need for providing spittoons, ink absorbent pads, or the like, at an ink-jet hard copy apparatus pen service station.

It is yet another advantage of the present invention that no potentially mechanism contaminating purge port connections are employed.

It is still another advantage of the present invention that no ink is wasted.

Other objects, features and advantages of the present invention will become apparent upon consideration of the following detailed description and the accompanying drawings, in which like reference designations represent like features throughout the FIGURES.

The drawings should be understood as not being to scale except where specifically noted.

DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable.

Figure 1:
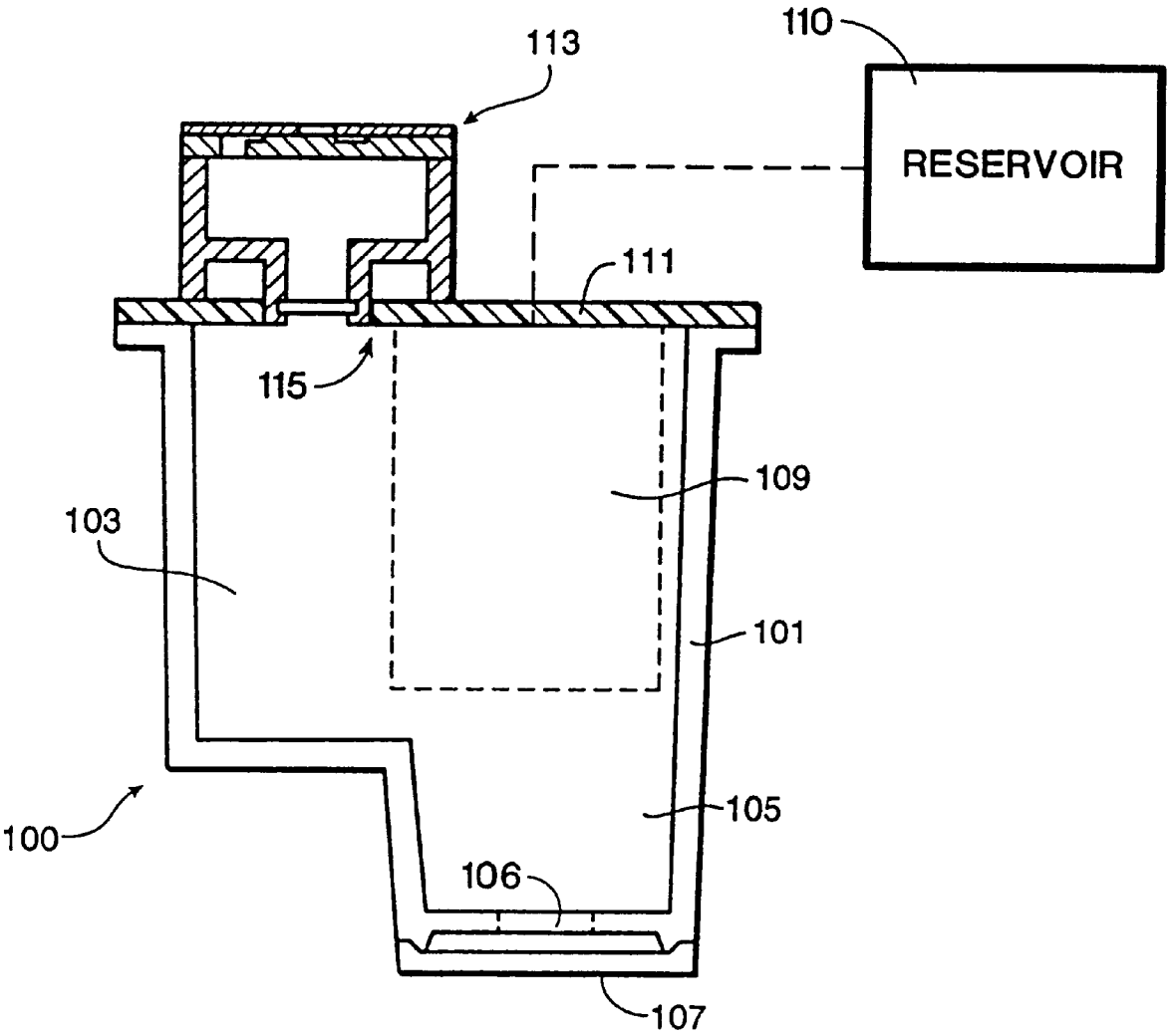
FIG. 1 is a simplified elevation view, in cross-section, of the present invention.

FIG. 1 shows a preferred embodiment of the present invention. An ink-jet pen 100 for a hard copy apparatus (not shown) includes a pen body 101, having a snout portion 105, that forms a local ink containment chamber 103. A printhead mechanism 107 is mounted on the snout portion 105 for appropriate interfacing with a print medium (not shown). The printhead mechanism 107 is driven by an appropriate controller (not shown) as would be known in the art. A pressure regulator and remote ink reservoir interconnect device 109, represented by a phantom line element, such as disclosed by the assignee of the present invention in U.S. patent application Ser. No. 08/065,957, incorporated herein by reference, is included within the pen body 101. Basically, ink is supplied from an off-board ink reservoir (not shown) into the ink containment chamber 103 by pressure regulation within the pen body 101 that is designed to maintain an predetermined back-pressure at the printhead mechanism 107.

During optimal design operation, ink from a remote reservoir (not shown) substantially fills the ink containment chamber 103 from the printhead mechanism 107 to the inner surface 115 of a pen body lid 111. A pen body lid 111 incorporates a gas separation and purge device 113 in accordance with the present invention.

Figure 2:
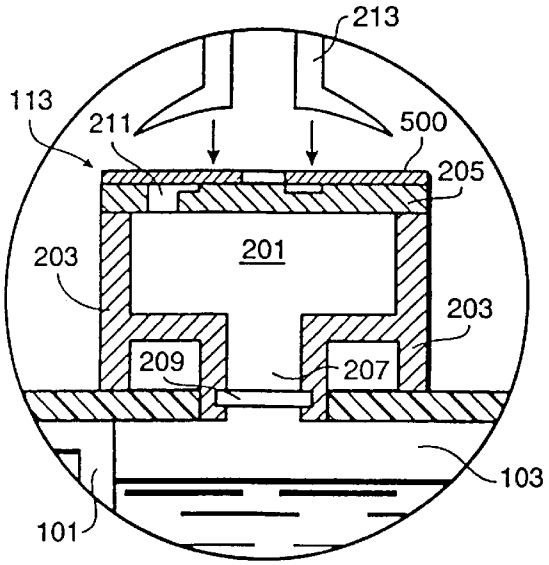
FIG. 2 is a plan view of the encircled portion of FIG. 1 showing a suction cap above the separator of the present invention.
Figure 3:
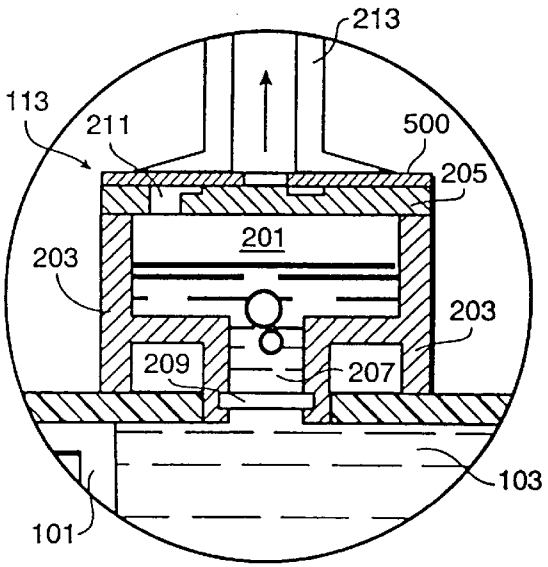
FIG. 3 is a repetition of FIG. 2 showing the suction cap engaged with the separator of the present invention.
Figure 4:
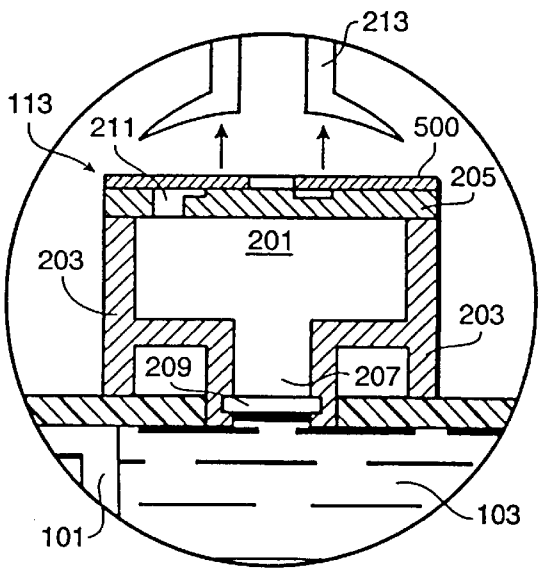
FIG. 4 is a repetition of FIGS. 2 and 3 showing the suction cap being removed from the separator of the present invention.

Turning now to FIGS. 2, 3 and 4, the gas separation and purge device 113 and its operation is shown in more detail. A separator chamber 201 is formed by walls 203 and a separator chamber lid member 205. The separator chamber 201 includes a passageway portion 207 that couples to the ink containment chamber 103. A mesh screen 209 is mounted (such as by a press-fit, a heat stake, an ultrasonically weld, an adhesive mounting, or the like, as would be known in the art) in the passageway portion 207 proximate the ink containment chamber 103. It has been found that that a screen 209 having an approximately twelve micron mesh and fabricated of a material, such as stainless steel, that does not react with liquid ink is suited to the operation of the present invention. The mesh screen 209 acts as a bubble generator in that a meniscus of ink will form over each aperture of the mesh due to the surface tension of the ink and a differential pressure will then pull the gases past these menisci. The differential pressure is determined by the surface tension of the ink, the size of the apertures, and the contact angle of the ink with the mesh.

Figure 5:
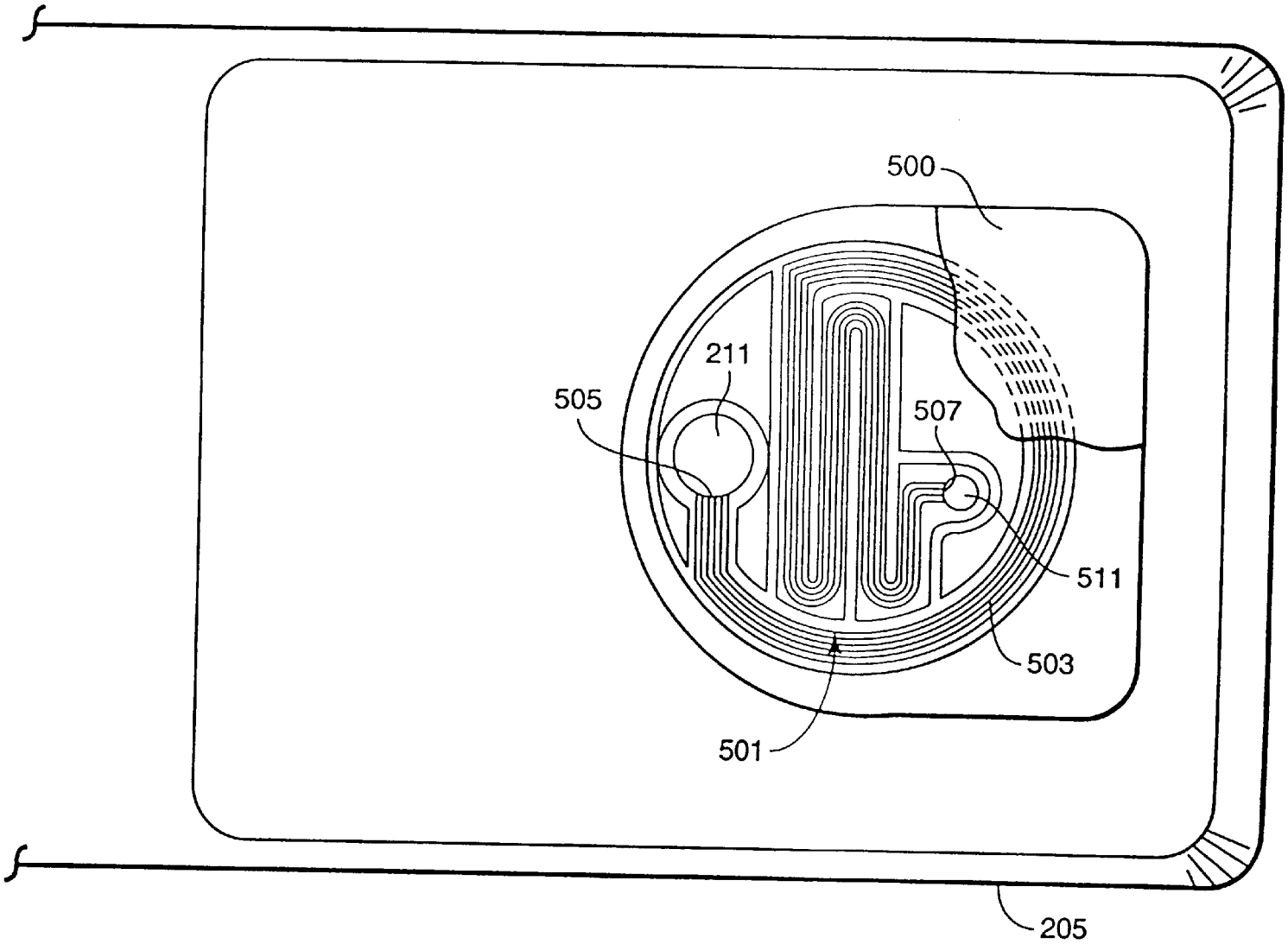
FIG. 5 is a plan view (top) of the present invention as shown in FIG. 1 showing a gas purge labyrinth.

The separator chamber lid member 205 includes a through port 211. Referring also to FIG. 5, a cap member, or top plate, 500 (shown in a partially cutaway depiction) is mounted superjacent the lid member 205. The cap member 500 also has a port 511 and the two ports 211, 511 are coupled such that in operation a suction device 213 (FIGS. 2–4 only), when engaged cap member 500, is substantially sealed to the cap member 500 as shown in FIG. 3.

In operation, as the pen 100 moves into a hard copy apparatus service station (not shown) as would be known in the art, such as in U.S. Pat. No. 4,567,494, assigned to the assignee of the present invention and incorporated herein by reference. A suction device 213 comes down (FIG. 2, arrows) and is substantially sealed against the cap member 500 (FIG. 3). A vacuum is applied (FIG. 3, arrow) pulling a predetermined, fixed volume of air, or air and ink, into the separator chamber 201. If all the gas has been removed from the containment chamber 103, ink may also be drawn into the separation chamber. The suction device is then vented to the atmosphere (FIG. 4). This allows the ink to be pulled back into the ink containment chamber 103 by the back-pressure created by the regulator 109. The gas is vented to the atmosphere. If all the gas has not been removed from the containment chamber 103 in one suction and vent cycle, the cycle may be repeated. On the next cycle, no ink will be drawn into the ink containment chamber 103 from the remote reservoir (not shown) because the back-pressure has been reduced below the regulator 109 working pressure. The volume of the purge stroke and separation of ink and gas must be predetermined so that the regulator 109 is able to re-absorb that volume while remaining in a good pressure range for printing. Thus, in a regulated pen, ink will be drawn into the ink containment chamber 103 from the remote reservoir (not shown) to replace the expelled gas and depleted ink as need.

The separation and purge operation is repeated cyclically as needed, for example, once every X pages of printing as may be determined during design of the particular hard copy apparatus and the specific pen design therefor.

Note that the suction device 213 need not be a make-break connection as demonstrated in FIGS. 2–4, but could be plumbed to the gas separation and purge device 113. In a multi-pen hard copy apparatus, each gas separation and purge device 113 can be purged using a single vacuum pump (not shown). The main requirement is that the stroke volume be controlled for each pen 100 of the apparatus and that the vacuum line be vented to the atmosphere after each stroke.

To prevent undesired air from entering into the pen when the suction device 213 is decoupled and to minimize the evaporation of ink from the pen, the separator chamber lid member 205 includes a labyrinth 501 which serves as a vapor barrier. An exemplary labyrinth 501 is depicted in FIG. 5. The labyrinth 501 is a twisted passage path 503 through which ambient air must travel before entering the separator chamber 201 via port 211. The ratio of the cross-sectional area to length of the labyrinth 501 should be such that the volume of gas within effectively blocks convective mass transfer. The appropriate dimensions of an labyrinth 501 for any particular pen 100 embodiment can be empirically determined by a person skilled in the art using Fick's Laws of Diffusion.

A proximal end 505 of the labyrinth 501 opens to the port 211 of the separator chamber lid member 205; a distal end 507 is open to the ambient atmosphere via a distal port 511. The length passages 503 of the labyrinth is sealed atmosphere (cutaway in view) from both the ambient atmosphere and the separator chamber 201 by a cover 500 and the lid 111 inner surface 115 (FIG. 1) except for the distal port 511 used to couple to the suction device 213. Humidity within the labyrinth varies along its length from a high value at the proximal end 505 to approximately ambient atmospheric pressure at the distal end 507. This humidity gradient serves to shield the ink from direct contact with ambient air.

Figure 10:
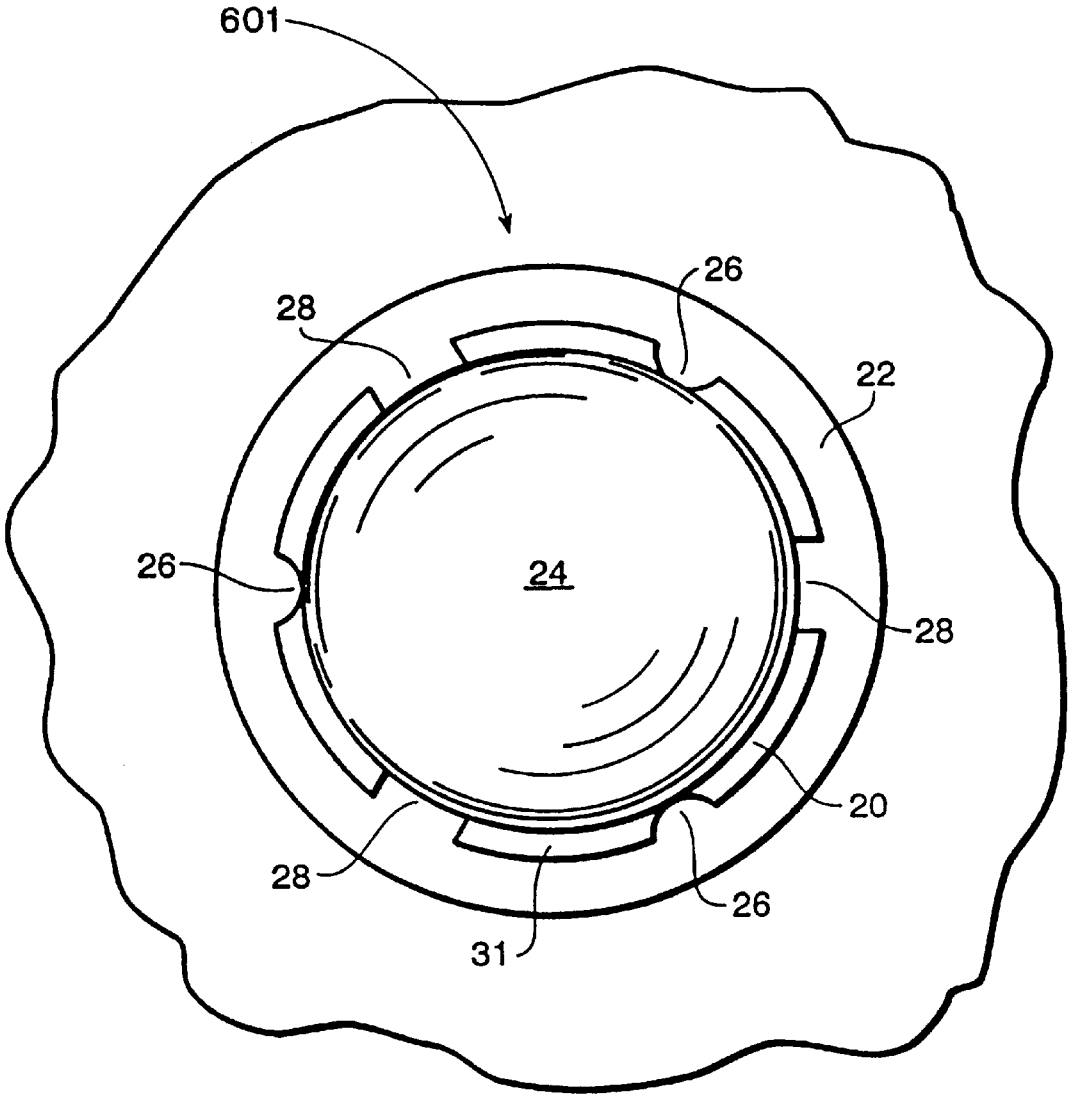
FIG. 10 is a plan view (top) of a bubble generator type mechanism employed in the alternative embodiment of the present invention as shown in FIGS. 6 through 9.

An alternative embodiment of the present invention is shown in FIGS. 6 through 10. In this embodiment, the mesh screen 209 has been replaced with a hydrophilic ball bubble generator mechanism 601. The passageway 207 between the separator chamber 201 and the ink containment chamber 103 can be designed as a tubular boss 22. A sphere 24, such as a steel ball, is mounted concentrically within the boss 22. As best seen in FIG. 10, the outside diameter of the sphere 24 is smaller than the inside diameter of the boss 22 to define an annular orifice gap 20. In the illustrated embodiment, the sphere 24 is maintained within the boss 22 by a number of raised crush ribs 26 formed around the interior of the boss 22. In this manner, the sphere 24 can be easily press-fit into the boss 22 and firmly maintained in position by the crush ribs 26. Additional raised ribs 28 are also provided to help maintain the sphere in position away from the inside wall 31 of the boss 22. Any combination of ribs 26, 28 may be used as convenient to a particular embodiment design.

Figure 6:
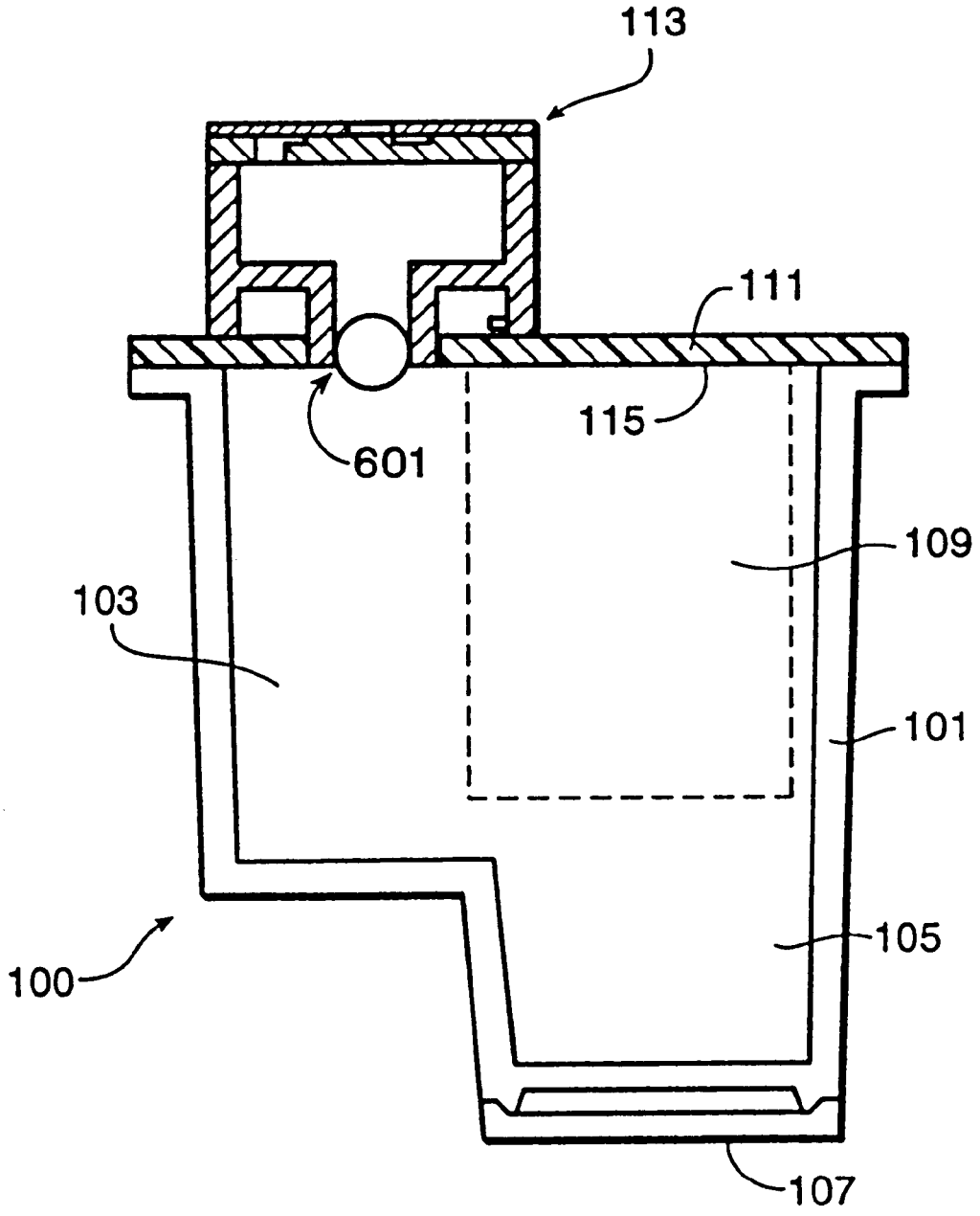
FIG. 6 is a simplified elevation view, in cross-section, of an alternative embodiment of the present invention.
Figure 7:
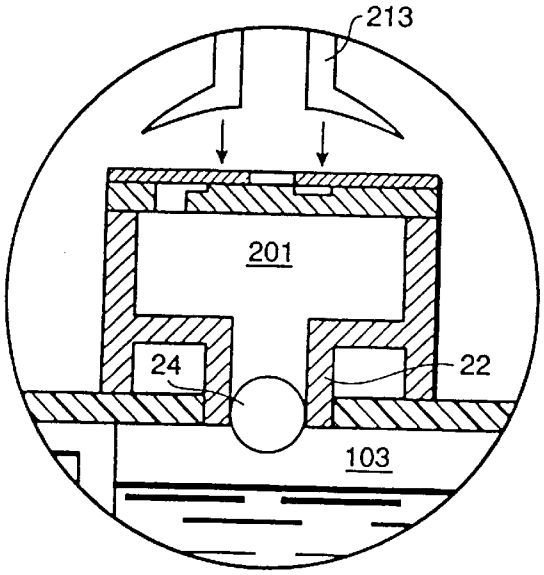
FIG. 7 is a plan view of the encircled portion of FIG. 6 showing a suction cap above the separator of the present invention.
Figure 8:
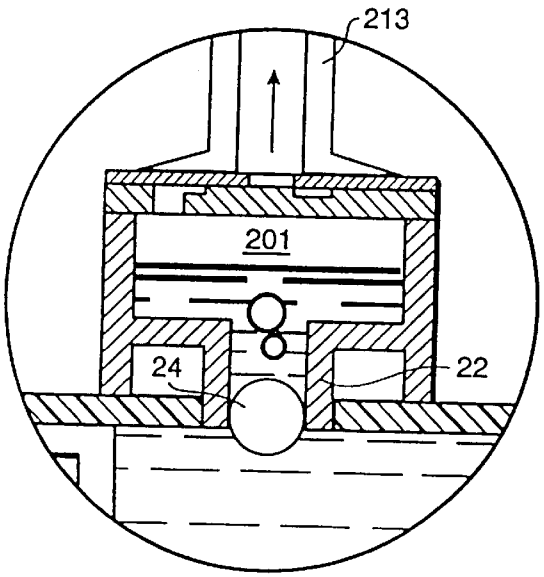
FIG. 8 is a repetition of FIG. 7 showing the suction cap engaged with the separator of the present invention.
Figure 9:
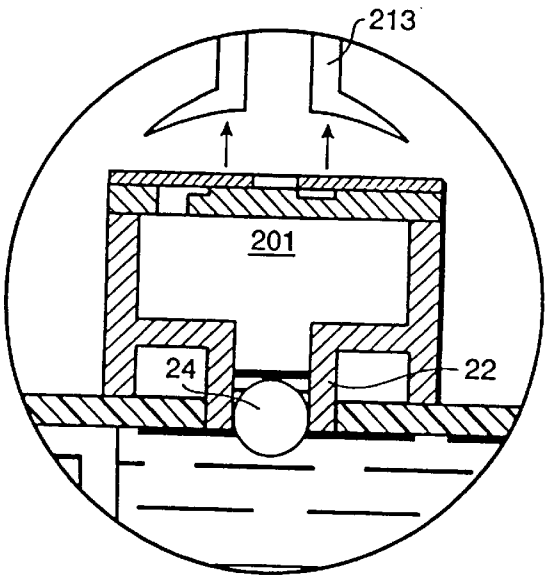
FIG. 9 is a repetition of FIGS. 7 and 8 showing the suction cap being removed from the separator of the present invention.

The sphere 24 serves as a capillary member. Due to the curved surface of the sphere 24, gaps 20 between the exterior surface of the sphere 24 and the inner wall 31 of the boss 22 are smallest at the orifice formed between the separation chamber 201 and the ink containment chamber 103 and increases as the distance from the orifice increases. This geometry, coupled with the capillarity of the ink, constantly urges a trapped quantity of ink into the orifice, allowing the hydrophilic ball mechanismn 601 to act as a bubble generator as shown in FIG. 8. In other words, the hydrophilic ball mechanism 601 is designed as a bubble generator that bubbles at two to three times the regulated back-pressure. When the suction device 213 is removed, any free ink in the separator chamber 201 is free to run back into the ink containment chamber 103 under the influence of the back-pressure created by the regulator 109 (FIG. 6). Air will not pass into the ink containment chamber 103 unless the pressure forces it in. Note that any air removed from the ink containment chamber 103 will be replaced by ink drawn in from the remote reservoir (not shown). Once all gases have been purged, the pressure will be balanced and a small volume of ink will cycle back and forth between the separator chamber 201 and the ink containment chamber 103, but the device will not draw in additional ink.

While the gas separation and purge device 113 is shown as affixed to the top of a downwardly firing pen 100, it will be recognized by those skilled in the art that as long as the device 113 is at the "high point" orientation of the pen 100 to the local horizontal when it is mounted in a pen carriage (not shown) of the hard copy apparatus such that accumulating gases rise toward the mesh screen 209 (FIGS. 1–4) or the hydrophilic ball mechanism 601 (FIG. 6), the operation is essentially the same.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various applications with various modifications are suited to the particular use contemplated. It is intended that the scope of the invention be defined by the claims appended hereto and their equivalents.

What is claimed is:

1. A method for separating and purging gases from a back-pressure regulated, refilling, free-ink ink-jet pen having an ink containment chamber, comprising the steps of:

providing said pen with a separation chamber superiacent said ink containment chamber having a predetermined volume capacity where gases accumulate;

releasing gases from ink as ink and gas mixtures enters said separation chamber; and cyclically applying a vacuum force to said separation chamber to remove a predetermined volume of gases or mixture of ink and gases from said ink containment chamber into said chamber such that gases are vented to ambient atmosphere and ink is free to return to the ink containment chamber.

2. The method as set forth in claim 1, further comprising the step of:

hydrophillicly generating bubbles from dissolved gases in ink as ink enters said separation chamber.

3. The method as set forth in claim 1, wherein said step of providing said pen with a separation chamber further comprises the step of:

providing said separation chamber into said pen at a high point orientation such that gases within said pen rise toward said separation chamber and into an interior cavity thereof by an entrance mechanism into the cavity.

4. The method as set forth in claim 3, further comprising the step of:

ventilating the interior cavity to ambient atmosphere by providing said pen with a lid having a relatively long and narrow vent from said separation chamber to ambient atmosphere.

5. The method as set forth in claim 3, further comprising the steps of:

forming menisci of ink at the entrance mechanism to said separation chamber; and providing a differential pressure to pull gases past said menisci.

6. A method for separating and purging gases from a back-pressure regulated, refilling, free-ink ink-jet pen, having a pen body, an ink containing first chamber within the body; a print head fluidically coupled to the body below the first chamber, comprising the steps of:

providing the pen body with a second chamber having a vent to ambient atmosphere, wherein said second chamber is distally located from said print head atop the pen body;

collecting gases or mixtures of ink and gases in the second chamber by separating gases from ink within the first chamber as the ink enters said second chamber;

cyclically applying a vacuum force to said second chamber to remove a predetermined volume of gases or mixture of ink and gases to said second chamber; and ventilating said second chamber to ambient atmosphere such that said gases are purged from said second chamber.

* * * * *

UNITED STATES PATENT AND TRADEMARK OFFICE

CERTIFICATE OF CORRECTION

PATENT NO. : 5,988,806
DATED : November 23, 1999
INVENTOR(S) : Hall et al.

It is certified that error appears in the above-identified patent and that said Letters Patent is hereby corrected as shown below:

Column 6,
Line 60, delete “superiacent” and insert in lieu thereof -- superjacent --.

Signed and Sealed this

Tenth Day of September, 2002

*Attest:*

*Attesting Officer*

JAMES E. ROGAN
*Director of the United States Patent and Trademark Office*